US010388113B2

(12) United States Patent
Hamud

(10) Patent No.: US 10,388,113 B2
(45) Date of Patent: Aug. 20, 2019

(54) PLAYER VERSUS DEALER POKER VARIANT WITH FREE MONEY PROVIDED TO A PLAYER FOR CONTINUING GAME PLAY

(71) Applicant: Garry Hamud, Las Vegas, NV (US)

(72) Inventor: Garry Hamud, Las Vegas, NV (US)

( * ) Notice: Subject to any disclaimer, the term of this patent is extended or adjusted under 35 U.S.C. 154(b) by 172 days.

(21) Appl. No.: 15/796,813

(22) Filed: Oct. 29, 2017

(65) Prior Publication Data

US 2019/0130703 A1 May 2, 2019

(51) Int. Cl.
*A63F 1/00* (2006.01)
*G07F 17/32* (2006.01)

(52) U.S. Cl.
CPC ..... *G07F 17/3267* (2013.01); *G07F 17/322* (2013.01); *G07F 17/3288* (2013.01); *G07F 17/3293* (2013.01)

(58) Field of Classification Search
CPC ..... A63F 1/00; A63F 2001/005; G07F 17/32
See application file for complete search history.

(56) References Cited

U.S. PATENT DOCUMENTS

2008/0088087 A1* 4/2008 Weitzman ..... A63F 1/00 273/292
2009/0124315 A1* 5/2009 Snow ..... G07F 17/3244 463/13

* cited by examiner

*Primary Examiner* — Omkar A Deodhar
(74) *Attorney, Agent, or Firm* — Mark A. Litman & Assoc. P.A.

(57) ABSTRACT

In a wagering event based on dealer versus player poker ranks, initial player hand card ranks or combinations qualify a player for a value-enhancement activity that carries through to conclusion of the wagering event as a wager enhancement. The value-enhancement activity may include a non-redeemable marker placed adjacent to at least one wager, the value of which wager is increased or multiplied by the marker.

21 Claims, 10 Drawing Sheets

200 →

202 →

204 →

206 →

TRIPS

Royal flush ..... 50 to 1
Straight flush ..... 40 to 1
Four of a kind ..... 20 to 1
Full house ..... 7 to 1
Flush ..... 6 to 1
Straight ..... 5 to 1
Three of a kind ..... 3 to 1

FIGURE 4A

POCKET $$$

| | | |
|---|---|---|
| 8 | High | 1 |
| 7 | High | 1.5 |
| 6 | High | 2 |
| 5 | High | 3 |
| 4 | High | 4 |
| 3 | High | 5 |
| 2 | High | 10 |

FIGURE 4B

PLAYER VERSUS DEALER POKER VARIANT WITH FREE MONEY PROVIDED TO A PLAYER FOR CONTINUING GAME PLAY

BACKGROUND OF THE INVENTION

1. Field of the Invention

The present invention relates to novel wagering events in which a player competes against a dealer in a Texas Hold'Em format as either a live gaming table, electronic gaming table, electronic gaming machine and on-line formats.

2. Background of the Art

The use of poker games as casino table games and as competitive card room games has undergone a significant resurgence in the past twenty years. Both video game versions, live table physical playing card versions, electronic gaming table versions and mixed physical and electronic systems have been used with many variations of poker. Among the more successful games are video draw poker (and its multiline variations), Three-Card Poker™ game, Four-Card Poker™ game, Texas Hold-'Em, Omaha poker, and the like.

Although both Texas Hold-'Em and Omaha Poker are very successful in card room environments, only Texas Hold-'Em has found any success in casino-banked variants or developed any new successful variants. Among the variants are those described below.

Published US Patent Application Document No. 20060284376 (Snow) describes a variant game of Hold'Em poker that allows for rules of play of one or all of Players being allowed to remain in game with an option of checking or making specific wagering amounts in first Play wagers, being limited in the size of subsequent available Play wagers or prohibited from making additional Play wagers if a first Play wager has been made, being limited in the size of available later Play wagers if a first or earlier Play wager has been made, and having the opportunity for at least two and as many as three or four distinct opportunities in the stages in the play of hand to be able to make one or more Play wagers.

Published US Patent Application Document No. 20090124315 (Snow) describes a wagering game methods and apparatus for playing a Draw Poker type live casino and/or electronic game against a dealer and/or a pay table. Players place an ante wager to participate in the game. Each player and the dealer are dealt initial hands. Each player may discard any portion including all of his or her cards. The dealer discards according to predetermined criteria. Discarded cards are replaced by community draw cards in a specified order to complete final hands. Alternatively, each player and the dealer may be dealt their initial hands and replacement cards from their own associated decks. The ante wager is paid if the player's final hand outranks the dealer's final hand. An optional ante wager is paid according to a paytable if the player's final hand achieves at least a minimum bonus qualifying rank.

U.S. Pat. No. 6,581,936 (Zoccolillo) describes a casino card gaming method utilizing a conventional fifty-two card deck and begins by first determining the players for a given round. Players may elect to be eligible for receiving a bonus card. The individual players' hands, a set of common cards and a bonus card for players eligible for the bonus card are dealt. Players which continue through the round determine whether to play the hand as dealt or to utilize the common cards. Players utilizing the common cards discard a number of cards from their hands equal to the number of common cards. The relative ranking of the final hands for the players is determined with the relative ranking based upon the statistical likelihood of obtaining predetermined combinations of cards.

More variations in wagering games are desirable, especially as it is difficult to convert known wagering events such as poker games into casino table games that are easy to understand, easy to administer by the casino and yet offer reasonable numbers of winning events and opportunities to players. One of the significant successful stud poker games is Mississippi Stud™ poker. Mississippi Stud™ Poker is a popular table game known throughout the world but is especially popular in casinos surrounding the state its named after. While it won't take you very long to learn how to play Mississippi Stud Poker, it will take some time to develop and remember strategies.

Published US Patent Application Document No. 2015/0310830 (Hwang) discloses a method of performing a wagering event modifies a Texas Hold'Em game at a gaming table. A player position two-card hole cards competes with a dealer position two-card hole cards. Five community cards are used as in Texas Hold'Em. Player wagers are placed at various stages of display of community cards to have the event continue. Failure to make player wagers at any time causes the game to end. All wagers are resolved in competition with the position hand. There is a controlling dealer hand rank requirement.

Mississippi Stud Poker™ game is played on traditional card tables, and is similar to Texas Hold'em, but has its own unique twists. The game begins with each player making an ante wager. After players ante up, they are each dealt two cards, face down. The dealer then will put three community cards face down in the middle of the table. These will be revealed at a later time, Players can either fold at this point or continue to play. However, if the decide to continue to play, they must wager three times their original ante bet to complete the hand and collect their winnings.

If the players decide to keep playing after seeing their original cards, they must wager in the table's first circle called "Third Street." The wager must equal the ante, though it can be up to three times the amount of the ante bet. This is when the dealer shows the first community card. Now that the remaining players can see the community card, they can both fold and lose the money that they've bet thus far, or they can wager again, up to three times their original ante bet. If the players continue to play, their wagers are placed in the "Fourth Street" circle on the table. That's when the dealer reveals the second community card.

Once the second community card has been revealed, players can fold and lose all the money that they have bet or they can once again bet up to three times the original ante bet. If they decide to wager again, the money is placed in a circle on the table known as "Fifth Street." This ends the chance to wager for the current hand, Now, the dealer reveals the final community card.

A player who has either a five-card hand or at minimum of a pair of six's will not be a loser. Any pair of cards six through ten represents a push whereby the player wins back all of his wagers that he made throughout the entire hand. He then starts the next hand out with a new ante bet. Players with five card hands can win big money, especially if their hands are of the "higher" sort. The highest payout is a Royal Flush at 500 to 1. A Straight Flush comes next at 100 to 1.

Four of a kind pays 40 to 1, A full house provides 10 to 1. A flush is 6 to 1. A straight is 4 to 1. Three of a kind is 3 to 1. Two pairs is paid at 2 to 1. A pair of jacks or higher is a 1 to payout.

To date, all casino Texas Hold'em variants to make significant impact on the casino floor have one of four things in common, most of which run contrary to actual Texas Hold'em play—Without exception, these games have placed an undue emphasis on pre-flop betting. The largest wagers appear pre-flop, whereas in real poker, the bets get bigger as the hand progresses and the pot gets bigger. None of these games present a meaningful bet-or-fold decision on the flop. Any dealer qualifiers relate to the ante wagers, and not to the play wagers.

Ultimate Texas Hold'Em game

In Ultimate Texas Hold'em, the player places two forced wagers-—an Ante and equal Blind wager—and has three opportunities to make a single wager. The player may: Bet 3× or 4× pre-flop, or Bet 2× on the flop, or Bet 1× on the river Indeed, the largest wagering opportunity in Ultimate Texas Hold'em occurs pre-flop, while the allowed bet sizes decrease as the hand progresses. Moreover, the only bet-or-fold decision occurs on the river, as the player is allowed to check the hand down to the river before being forced to bet, or otherwise forfeit his Ante and Blind wagers. When the player makes a Play wager, the dealer only plays and pays the Ante wager when the dealer makes a pair or better; however, the dealer plays against the Play wager (whether 4×, 3×, 2× or 1×) regardless. This runs counter to real poker—and the original concept behind the use of qualifiers (as in Caribbean Stud® poker, and its predecessor Casino Poker, the latter which was invented by David Sklansky). That concept is that the dealer will only play against bigger wagers when the dealer holds a bigger hand.

Further developments in enabling wagering events similar to Texas Hold'Em are needed to attract players to gaming tables, and the new wagering events should have staying power in being interesting, appealing and offering unique wagering opportunities.

SUMMARY OF THE INVENTION

A system and method execute a poker wagering event. The event may be performed in an electronic environment (on-line, electronic gaming table, or electronic gaming machine) or on a live physical gaming table. In an electronic environment, virtual playing cards are provided. On a live table, the event is executed with physical playing cards between a player and a dealer banked by a wagering establishment and using a unique set of value-increasing marking elements. The method includes steps (with a physical playing table being used as an example) including:

providing a randomized set of physical playing cards comprising at least one standard deck of 52 playing cards;

at least one player placing an ante wager at an at least one player position for the at least one player;

providing exactly two random playing cards from the randomized set of physical playing cards to the at least one player position where the ante wager has been placed to form an initial player position two-card hand;

providing exactly two random playing cards from the randomized set of physical playing cards to the dealer position to form an initial dealer position two-card hand;

comparing a two-card poker hand rank of the exactly two playing cards at the at least one player position against a paytable, wherein at least some two card poker hand ranks require the dealer to place one value-increasing marker at the player position indicating that at least the ante wager has been multiplied in effective wagering value in execution of the poker wagering event; and five community playing cards are provided from the randomized set of physical playing cards for use in combination with each of the initial player position two-card hand and the initial dealer position two-card hand to form best five-of-seven five card poker hand ranks for respective the at least one player position and the dealer position;

comparing the best five-of-seven five card poker hand ranks for respective the at least one player position and the dealer position to determine a player position win, player position loss, or tie between the at least one player position and the dealer position;

wherein if the player position win results from the comparison, the ante wager is paid out according to a wagered amount of the ante and the value-increasing marker.

BRIEF DESCRIPTION OF THE FIGURES

FIG. 4A shows a pay table for events that may be executed in the underlying gaming event or as a side bet wagering event useful in conjunction with the Free Money Texas Hold'Em™ poker game.

FIG. 4B shows a pay table for events that may be executed in the underlying gaming event or as a side bet wagering event useful in conjunction with the Free Money Texas Hold'Em™ poker game.

DETAILED DESCRIPTION OF THE INVENTION

Figure 1:
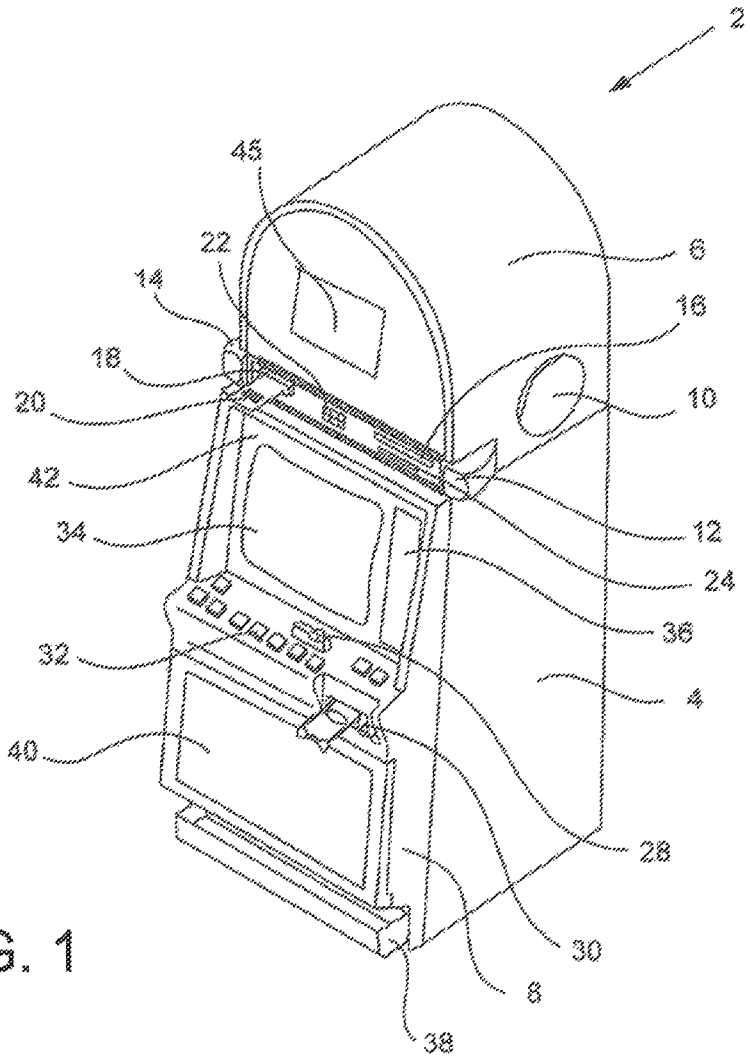
FIG. 1 shows an electronic gaming machine on which the gaming method may be executed.

A system and method execute a poker wagering event. The event may be performed in an electronic environment (on-line, electronic gaming table, mixed electronic wagering with physical playing cards, or electronic gaming machine) or on a live physical gaming table. In an electronic environment, virtual playing cards are provided to a display screen by a processor accessing memory and code. On a live table, the event is executed with physical playing cards between a player and a dealer banked by a wagering establishment and using a unique set of value-increasing marking elements. The method includes steps (with a physical playing table being used as an example, but with the underlying gaming structure being fundamentally equivalent in all modalities of execution) of at least:

providing a randomized set of physical playing cards comprising at least one standard deck of 52 playing cards (standard decks have four suits with thirteen ranks from 2, 3, 4, 5, 6, 7, 8, 9, 10, Jack, Queen, King and Ace). Additional cards such as wild cards, Jokers, and special event cards (e.g., bonus cards) may be added, but they alter fundamental game play and strategy in Texas Hold'Em and many players prefer pure forms of the wagering event;

at least one player placing an ante wager at an at least one player position for the at least one player;

providing exactly two random playing cards from the randomized set of physical playing cards to the at least one player position where the ante wager has been placed to form an initial player position two-card hand; At this point, two significant variations in events can be made. In a first variation, a value-enhancing marker (later defined herein) can be placed adjacent the Ante wager position or adjacent a later-to-be-executed Play wager position. Otherwise, a value-enhancing marker will be placed only after the player position has made a Play wager. These variations do not alter underlying probabilities or game strategies, but offers a mental enticement to players to continue the gaming event because they are basically having the value of their wagers increased without putting any more of the personal credit at risk at that point in the gaming event. The "value-enhancing marker" can be a physical token or chip or a lighting element on the gaming table adjacent the Ante wager position or the Play wager position. The vale-enhancing marker is "non-redeemable," which means that the marker cannot be taken to a cashier, dealer, ATM, kiosk or the like to be exchanged for direct value, such as a gaming chip, currency or coinage. The marker may have a credit value on it, but that value is of consequence only in that it effectively becomes an additional wager equivalent to the wager near where it is placed. If the marker is placed adjacent the Ante wager, it is as if that Ante wager were increased by or multiplied by the marker. For example, if a 10.00 Ante wager has been made, the value-enhancing marker may have a single inherent effect on the wager as defined by the casino or may have a single defined effect noted on the marker, as according to the following table:

| INDICATOR ON MARKER | EFFECT |
|---|---|
| No Specific Indication | Increases the wager by $10.00 (the Ante wager amount) |
| $5.00 (non-redeemable) | $5.00 added to the wager |
| 1.5X | $5.00 added to wager |
| 2.0X | $10.00 added to wager |
| X + 1X | $10.00 added to wager |

-continued

| INDICATOR ON MARKER | EFFECT |
|---|---|
| 2X Max $25 | $20.00 added to wager, but if wager had been higher, a $25.00 limit increase is present. |
| $1.00 Fixed | $1.00 added to wager, whether or not Play wager is made |

In the first six (6) indicators on the marking, the Play wager must be placed for that marker to be effective at the conclusion of the wagering event (if the player position wins). The seventh indicator on the marker is a unique alternative in that the Play wager, nor any other subsequent wager, need not have to be made.

The value-enhancing marker is provided only when specific conditions are present in the player position initial two card hand. These conditions are ranks of the two-card initial player position hand that are generally adverse cards for a player win. For example, a value-enhancing marker can be provided to a hand such as 2♠ and 7♣, or 3♥ and 8♦, which are suits and rank which cannot form a straight or flush easily and are low probability winning hands. These hands can still win if there is a matching good quality flop, turn and river cards in the completed wagering event, but the value-enhancing marker is an inventive to continue the round of play in the wagering event, even though the initial two-card playing hand is not a good hand to be aggressive with or with which to even continue play. However, the value-enhancing marker increases the reward of winning, without immediately requiring the player position to risk more, with the initial exception of the Play wager. Even though a required Play wager is the enticement for continuing the wagering event, that increased amount of risk is balanced by an enhanced reward that is in addition to any amount of value actually placed at risk.

A next action in the wagering event is when the dealer (live in a physical card event and virtual in an electronic gaming event) provides exactly two random playing cards from the randomized set of physical playing cards (or randomized virtual playing cards in the electronic media) to the dealer position to form an initial dealer position two-card hand; The dealer position two-card hand is maintained in a face down position so that the Player position(s) cannot determine relative poker ranks among hands (Player position hands versus Dealer position hands).

The dealer (upon prompting by a player) will compare a two-card poker hand rank of the exactly two playing cards at the at least one player position against a paytable or more properly a look-up table, wherein at least some two card poker hand ranks require the dealer to place one value-increasing marker at the player position indicating that at least the ante wager has been multiplied in effective wagering value in execution of the poker wagering event. The specific ranks or combinations of playing cards do not change any potential winning outcome, but change only the incentive of a player to continue with a playing card wagering event, and changes a potential amount that a player may win because of the increased value amount in the wager contributed by the house. Samples of two-card combinations that may automatically receive a value-enhancing wager include, but are not limited to:

a) any two same-suited cards;
b) two same-suited cards that are not consecutive;
c) any two consecutive cards;
d) any two cards with at least a five count difference between ranks (e.g., 2 and 7, 3 and 9, 5 and King, and the like);
e) any non-pair with a highest card less than Jack;
f) any combination of different ranges such as any two non-touching (non-consecutive) cards with the highest card being less than 10 and any pair less than a pair of fours;
g) any other designed range of values that have a statistical probability of winning of less than a specific amount, such as less than 40%, less than 35%, less than 30%, or less than 25%, for example; and In some defined sequence, five community playing cards are provided from the randomized set of physical playing cards for use in combination with each of the initial player position two-card hand and the initial dealer position two-card hand to form best five-of-seven five card poker hand ranks for respective the at least one player position and the dealer position.

The dealer (or the processor acting as a virtual dealer) compares the best five-of-seven five card poker hand ranks for respective the at least one player position and the dealer position to determine a player position win, player position loss, or tie between the at least one player position and the dealer position;

If the player position win results from the comparison, the ante wager is paid out according to a wagered amount of the ante and the value-increasing marker. The value-enhancing markers are always collected after the conclusion of a round of play as a security precaution. In executing the wagering event, there may be a single specific-acting marker controlled by the dealer (this is the simplest version) or there may be multiple types of different acting markers controlled by the dealer that are distributed according to different player position initial two-card hand ranks. Thus, a player may be awarded a higher quality value-enhancing marker for the worst hands for which value-enhancing markers are provided, and lower quality value-enhancing markers for the best initial two-card player position hands. For example, for any player position initial two-card hand of an unsuited 2 and 8, the player may be given a value-enhancing marker of 2× for the Ante wager (which itself may have a range available of 1-3× the Ante wager. On the other hand, for a player position initial two-card hand of a (theoretically allowable) pair of 4's, the marker may indicate that the Ante wager is effectively increased by 50%. This increase in the Ante wager may or may not be allowed to increase the size of the Play wager than can be provided. For example, if the wagering event allows a maximum Play wager of 2× the Ante wager, the "Ante wager" must be defined by the casino as either being the original Ante wager of the value-enhanced combination of original Ante wager and the effect of the marker.

It is simplest to a single type marker used as a value-enhancing marker, with one marker available for each player position. More markers are superfluous if there is only a single type of value-enhancement. It is less preferred to have more than two different types of value enhancement markers as this would tend to complicate decisions by dealers, but wagering events with three or four different types of markers can, of course, be designed. Another format for the markers could be electronic displays such as small screens (e.g., LED or liquid crystal screens), panels, bulbs, flip panels, seven-segment displays, and the like. Where there are automatic card reading systems, read card data may be monitored by a processor, which will command an appropriate value-enhancing signals by the electronic displays, or there may be a dealer input control by which a live dealer enters the appropriate value-enhancement symbol for the marker.

Value-enhancing markers may be placed at specific locations marked on the gaming table, which can be done with a distinct printed area, a recessed area, or even an area with one-half of a fabric locking material (e.g., the hooks or the loops of a Velcro® type system), with the marker's having the other respective half of the fabric locking system (the loops or hooks, respectively).

The value enhancing markers should be made to have a distinctly recognizable difference from the casino's standard chips (including the colored roulette chips). The distinction may be in size, shape, color, surface pattern, printed content or combinations of these. For example, if the casino's standard wagering chips are 2.0 inches (5.08 cm) in diameter, There are additional aspects of the wagering events of the present invention that can include actions where the value-increasing markers have an indication of a numerical multiplier effect of the value-increasing marker on the ante; and/or a play wager is placed at the player position after the value-increasing marker has been placed at the player position. There are variations available in execution of the wagering event such as a) the play wager must have been placed at the at least one player position or the value-increasing marker is removed by the dealer, and b) if the play wager has not been placed at the at least one player position, the value-increasing marker is removed from the at least one player position. The community playing cards are deposited at a community playing card position on the gaming table and are deposited in subsets of fewer than five cards at a time, with wagering allowed at the at least one player position as a subset is deposited. The subsets of the five cards may be in distributions of all five cards at once, four cards then a single card, three cards then two cards, three cards than single cards delivered twice, two cards then one card then two cards, two cards then two cards then a single card, and the like. As noted previously, the value-increasing marker is a physical token or plaque or tile or electronic display having a numeric indication of a degree of multiplication provided in a player position winning outcome in the poker wagering event.

Another way of describing a method of executing a poker wagering event on a physical gaming table with physical playing cards between a player and a dealer banked by a wagering establishment and using a unique set of value-increasing marking elements can be presented as follows:

providing a randomized set of physical playing cards comprising at least one standard deck of 52 playing cards;

at least one player placing an ante wager at an at least one player position for the at least one player;

providing exactly two random playing cards from the randomized set of physical playing cards to the at least one player position where the ante wager has been placed to form an initial player position two-card hand;

providing exactly two random playing cards from the randomized set of physical playing cards to the dealer position to form an initial dealer position two-card hand;

comparing a two card poker hand rank of the exactly two playing cards at the at least one player position against a paytable, wherein at least some two card poker hand ranks require the dealer to place one value-increasing marker at the player position indicating that at least the ante wager has been multiplied in effective wagering value in execution of the poker wagering event; and five community playing cards are provided from the randomized set of physical playing cards for use in combination with each of the initial player position two-card hand and the initial dealer position two-card hand to form best five-of-seven five card poker hand ranks for respective the at least one player position and the dealer position;

comparing the best five-of-seven five card poker hand ranks for respective the at least one player position and the dealer position to determine a player position win, player position loss, or tie between the at least one player position and the dealer position;

wherein if the player position win results from the comparison, the ante wager is paid out according to a wagered amount of either the ante and the value-increasing marker and/or at least one play wager at the player position after provision of the exactly two random playing cards at the least one player position.

A system for enabling execution of a wagering event according to the present invention can be further described as:

a gaming table with a layout on a playing surface of the gaming table;

at least one standard poker deck comprising fifty-two playing cards;

multiple player positions at the gaming table, with wagering positions for each player position indicated on the surface of the gaming table;

at least one wagering position at a player position having markings indicating areas on the gaming table for placing at least a) an ante wager; b) at least one play wager; and c) a physical indicator for increasing at least one of the ante wager and the play wager;

wherein the physical indicator is a physical element movable and placeable by a dealer on the marking at the player position for placement of the physical indicator; and the physical indicator has no cashable value, but indicates an amount or multiplier added by the dealer to increase a player's wagered amount without requiring a player to risk any additional value other than the ante wager, the at least one play wager, and any side bets placed at the player position;

wherein the wagering event comprises a poker rank competition between distinct poker hands and each poker hand in the competition is formed from 1-2 hole cards in combination with multiple community cards. The marking at the player position may be most closely associated in location with respect to one of the markings on the gaming table surface for placing the ante wager or the at least one play wager.

The physical indicator may identify a specific non-redeemable cash amount or a multiplier applied to one of the ante wager and the at least one play wager, and preferably may be a multiplier value of between 1.5 and 4.0 directed at a specific wager.

Another way of describing a method of executing a poker wagering event on an electronic gaming machine with virtual playing cards between a player and a virtual dealer according to the present invention may include steps such as:

providing an electronic gaming machine comprising a housing, a visual display at a player position, a processor with memory, and a player input control at the player position comprising a value-in-value-out system selected from the group consisting of a currency valuator, a ticket-in-ticket-out reader and printer, and a near-field transmitter/receiver for electronic fund transfer, the memory providing random outcome distribution of virtual playing cards from a randomized set of virtual playing cards comprising at least one standard deck of 52 playing cards;

a player placing an ante wager through player wager controls at the player input position;

the processor providing images of exactly two random virtual playing cards from the randomized set of virtual playing cards to the visual display to form an initial player position virtual two-card hand;

the processor providing images on the visual display of exactly two random is virtual playing cards from the randomized set of virtual playing cards to a virtual dealer position to form an initial dealer position virtual two-card hand;

comparing a two-card poker hand rank of the exactly two virtual playing cards at the at least one player position against a paytable, wherein at least some two card poker hand ranks require the processor to place one virtual value-increasing virtual marker at the player position indicating that at least one of the ante wager and a subsequent play wager has been increased in effective wagering value in execution of the poker wagering event; and five community virtual playing cards are provided from the randomized set of virtual playing cards for use in combination with each of the initial player position two-card virtual hand and the initial virtual dealer position two-card virtual hand to form best five-of-seven five virtual card poker hand ranks for respective the at least one player position and the virtual dealer position;

comparing the best five-of-seven five virtual card poker hand ranks for respective the at least one player position and the virtual dealer position to determine a player position win, player position loss, or tie between the at least one player position and the virtual dealer position;

wherein if the player position win results from the comparison, the ante wager is paid out according to a wagered amount of the ante and the value-increasing virtual marker.

Reference to the Figures will assist in an even further understanding and appreciation of the wagering events enabled by the present invention.

FIG. 1 shows an electronic gaming table on which the gaming method may be executed.

Figure 1A:
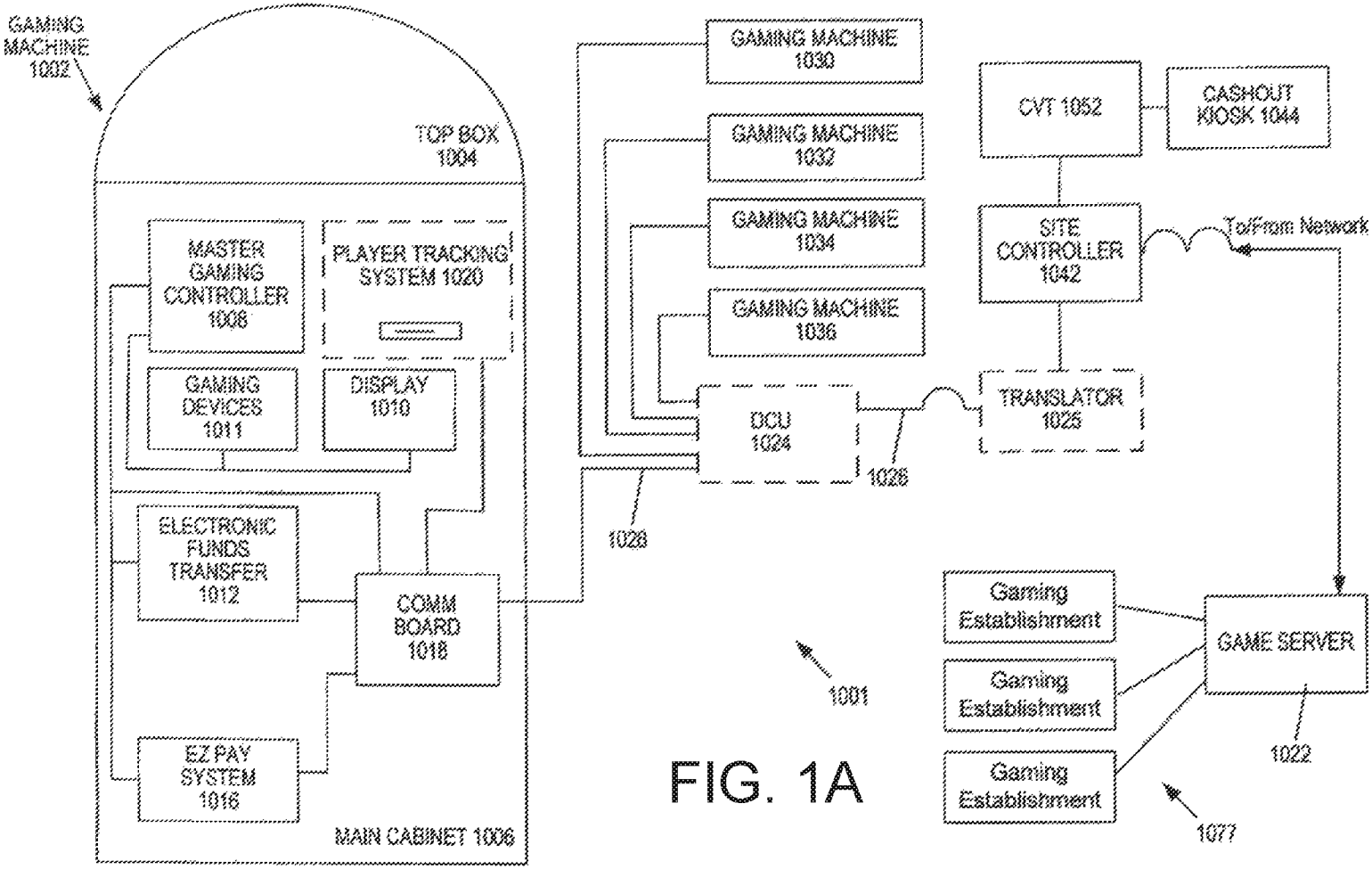
FIG. 1A shows a schematic for an electronic system for enabling play of the gaming method described herein.

FIG. 1A shows a schematic for an electronic system for enabling play of the gaming method described herein.

Figure 1B:
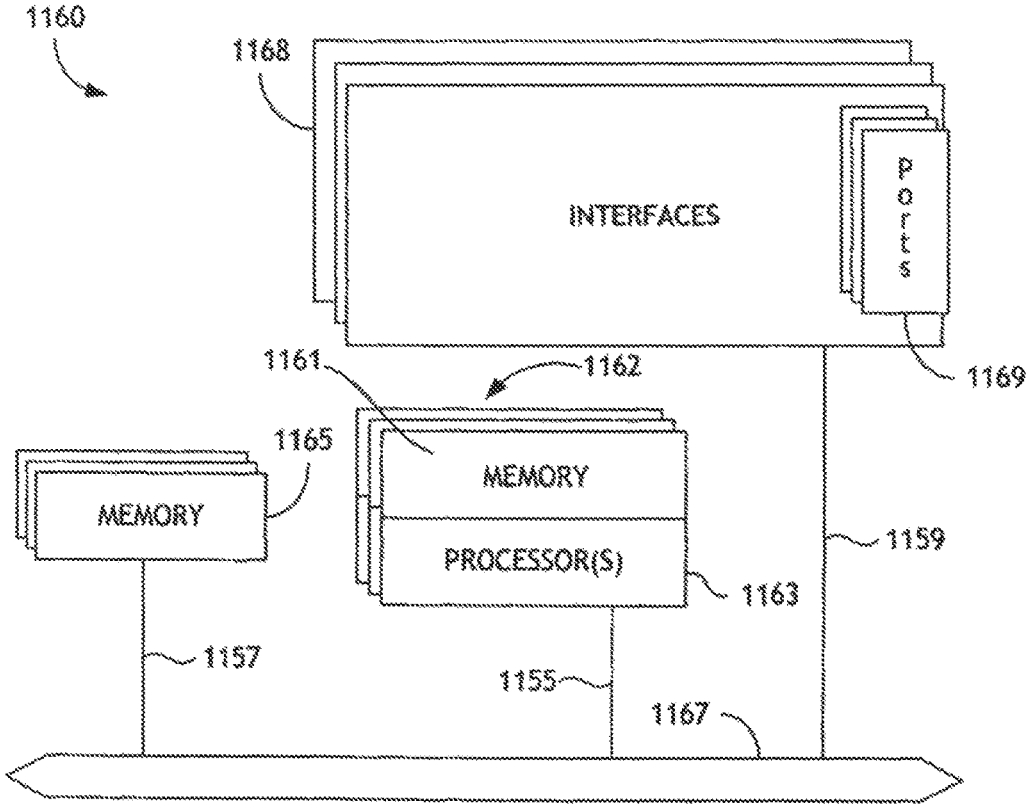
FIG. 1B shows another schematic for an electronic system for enabling play of the gaming method described herein.

FIG. 1B shows another schematic for an electronic system for enabling play of the gaming method described herein.

Figure 2A:
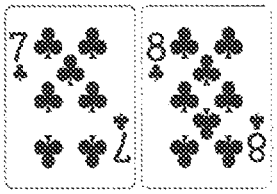
FIG. 2A shows two random physical playing cards dealt to each of three Player position hands and a dealer position hand after an Ante wager has been placed at the three Player positions.
Figure 2A:
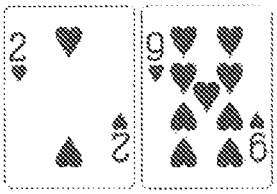
Figure 2A:
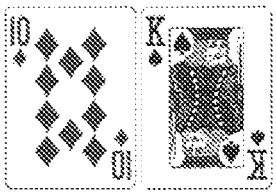
Figure 2A:
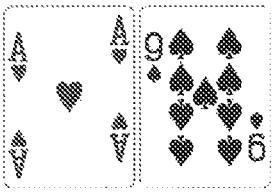

FIG. 2A shows the three Player positions hands (202, 204 and 206 for the three player positions) and the Dealer position hand (200) after an Ante wager has been placed at each of the three player positions. The Dealer position hand 200 has its cards face down so that players are not aware of card ranks in that hand. It is possible to have the cards up, but that can alter game strategy for players and shift an advantage towards the players in their wagering strategies. The Player position hands only hands (202, 204 and 206 for the three player positions) are evaluated against a paytable to determine if a Free Monet Poker™ value-enhancing marker is to be received by respective ones of the three Player position hands (202, 204 and 206 for the three player positions). Looking at the respective Player position hands of 202 2♥ 9♥ and 204 10♦K♠ and 206 A♥9♠, a paytable that awards a value-enhancing marker to only relatively low value Player position hands (e.g., a hand with no two consecutive and/or same-suited cards, and no card above a rank of 10) would cause the system (whether live, electronic or blended live and electronic) to award a value-enhancing Free Money Poker™ game marker to only Player position hand 202 because of its low value according to the paytable (or look-up table). A game theory strategy behind this award is that relatively quality hands in a four player event (actually a two-player event as Player positions are not competing against each other, but only against the Dealer position), such as 204 10♦K♠ and 206 A♥9♠, would remain in the continuing wagering event. The low quality Player position hand 202 would ordinarily fold at this point, even though that Player position 202 still has a realistic statistical chance of winning the wagering outcome against the Dealer position hand. However, even though the "gift" of the Free Money Poker™ game value-enhancing marker does not alter the probability of that Player position hand 202 winning the gaming event, that marker increases the amount that Player position hand 202 could win with "Free Money." This is an incentive for player positions to remain in the gaming event by making a First Play wager, not only through the first round of wagering, but to the conclusion of the gaming event.

Figure 2B:
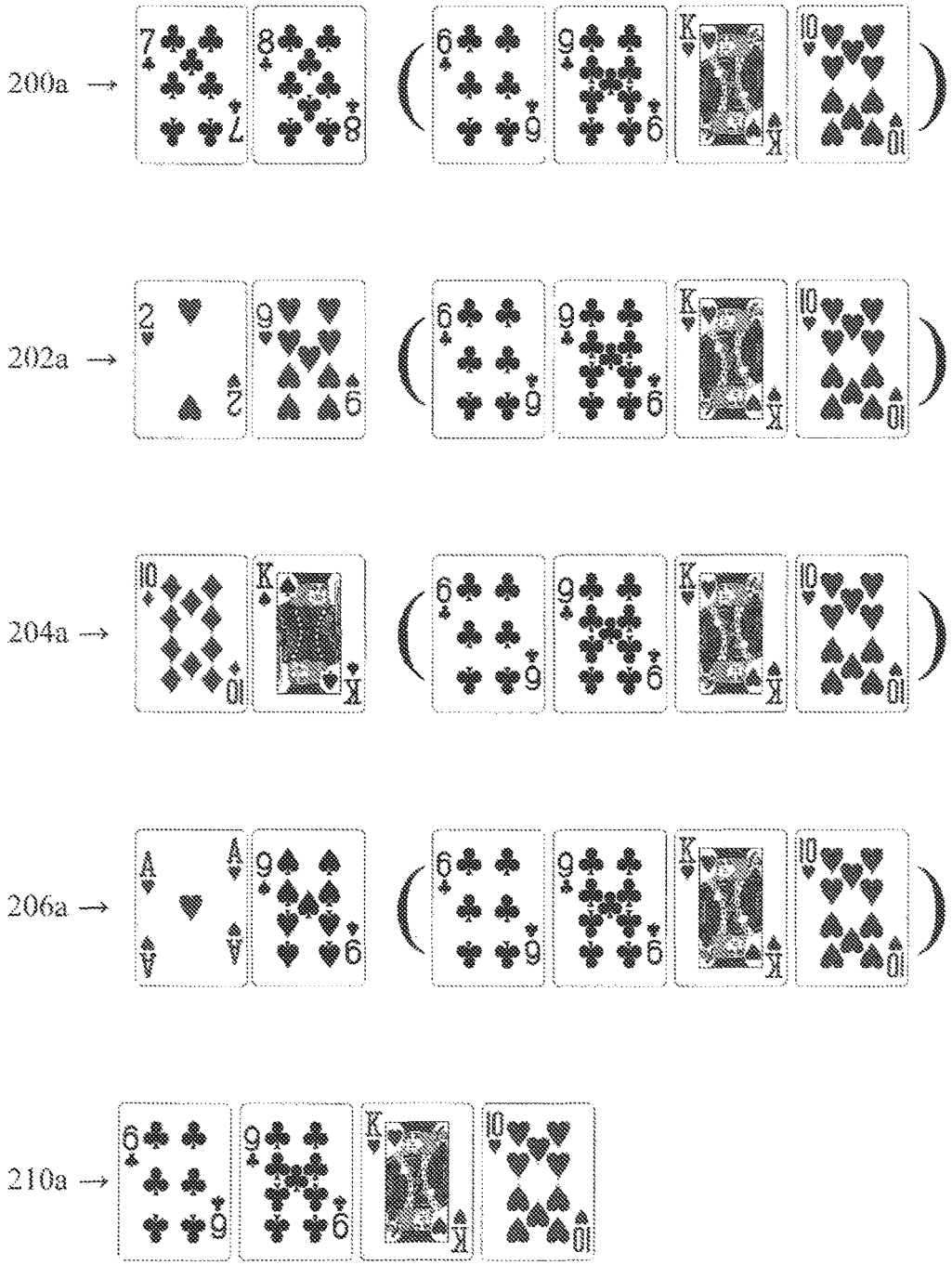
FIG. 2B shows the three Player positions hands and the Dealer position hand after delivery of a four-card Flop to a Community Card Region (or staging area) of the gaming area.

FIG. 2B shows the three Player positions hands (202*a*, 204*b* and 206*c* for the three player positions) and the Dealer position hand (200*a*) after delivery of a four-card Flop 208*a* to a Community Card Region (or staging area) of the gaming area. The four-card flop 210*a* ranks are shown in parentheses adjacent the original three Player positions hands (202*a*, 204*b* and 206*c*) to assist in evaluating the ongoing ranks of the respective hands four hands 200*a*, 202*a*, 204*a* and 206*a*. The respective poker ranks of the four active hands are now 200*a* (Dealer position has a hidden "nut straight of 6, 7, 8, 9 and 10, unsuited; 202*a* has a pair of 9's; 204*a* has two pair 10's and Kings; and 206*a* has a pair of 9's and a flush draw. As the presently best hand of the Dealer position cannot make a wager, all Player positions are unaware of the Dealer position quality hand and would likely remain in the gaming event, even if a Second Play wager were required. If a range of wagers were available (not just 1× the Ante wager or 1× the First Play wager), such as 2× or 3× previous wagers, Player positions hands 204*a* and 206*a* might make the larger wagers.

Figure 2C:
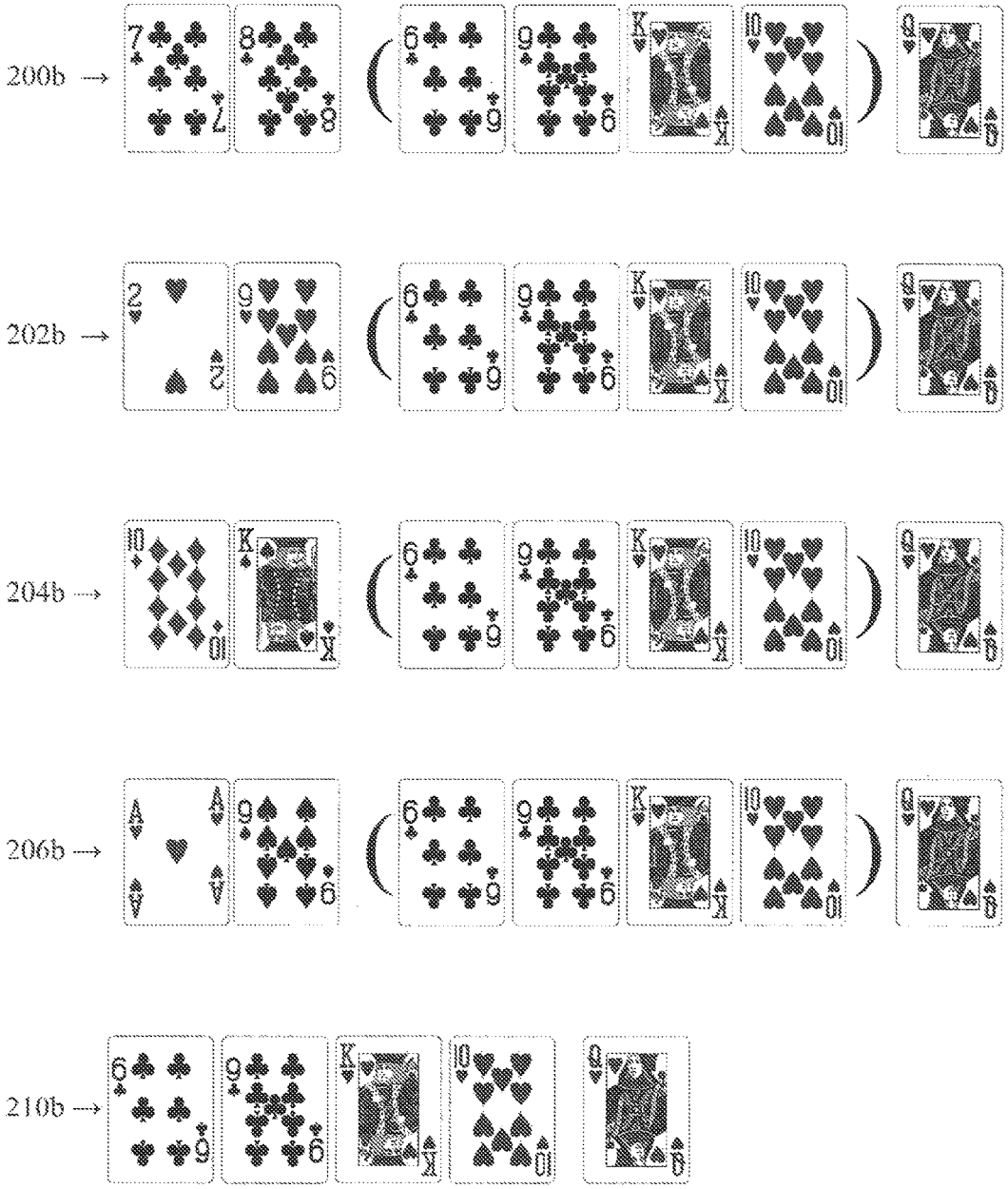
FIG. 2C shows the delivery of a final (River) additional random physical playing cards to the Community Card Region of FIG. 2B to complete delivery of all playing cards in one round of play of the gaming event.

FIG. 2C shows the delivery of a final (River) additional random physical playing cards to the Community Card Region of FIG. 2B to complete delivery of all playing cards in one round of play of the gaming event. The concluding best-of-seven five-card poker hands for the Dealer position hand 200*b* versus the three respective Player position hands 202*b*, 204*b*, and 206*b* would have only Player position hand 202*b* declared a winner, with a Flush on the River card versus the "nut straight" in the Dealer position hand 200*b*. Ant Free Money Poker™ markers placed during the gaming event at losing Player position hands would be collected by the dealer (or electronically eliminated by a processor or manually entered signal to the system. If a winning Player position final hand had been given such a marker during gaming event play, that marker would be appropriately rewarded, and the withdrawn from the gaming table.

FIG. 2 shows a top view of a physical table layout for a version of a wagering event within the practice of the present technology known as Free Money Texas Hold'Em™ poker game, including a uniquely identified area (Free $) for placement of a non-redeemable wager-enhancing marker adjacent at least one wager position on a player position at the gaming table. There is an area marked for display of community playing cards 302, an area for the dealer's position to be placed face down 304, and a series of displayed paytables 306 and 308, and two similar paytables inverted for view by the dealer 306*a* and 306*b*. An additional paytable 310 for odds for ranked hands on a side bet at each player position 312*a*, 312*b*, 314*c* and 313*d* are shown, with individual areas shown for ante, play, and side bet wagers identified as "Pay $$," "Small Blind," "Big Bling,", "Trips," and "Raise/Call" in addition to the "Free $" spot for the placement of the wager-enhancement marker.

FIG. 4A shows a pay table for events that may be executed in the underlying gaming event or as a side bet wagering event useful in conjunction with the Free Money Texas Hold'Em™ poker game.

FIG. 4B shows a pay table for events that may be executed in the underlying gaming event or as a side bet wagering event useful in conjunction with the Free Money Texas Hold'Em™ poker game.

Figure 4C:
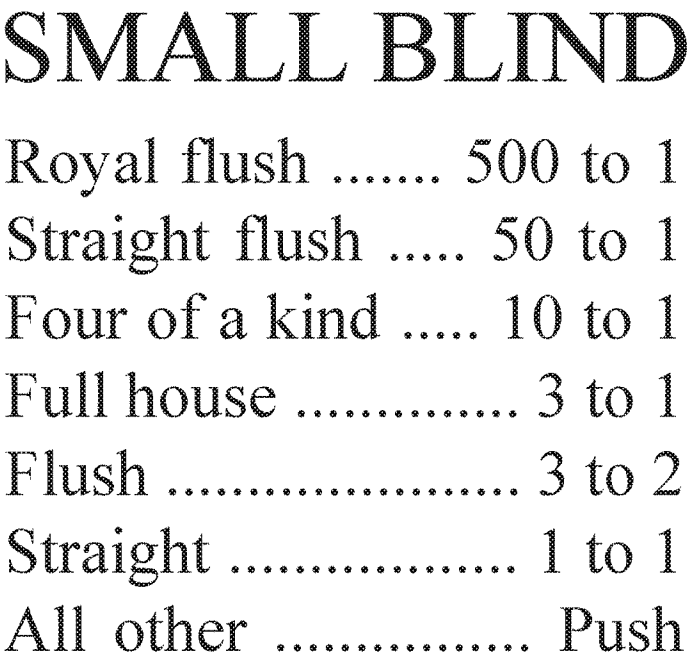
FIG. 4C shows a pay table for events that may be executed in the underlying gaming event or as a side bet wagering event useful in conjunction with the Free Money Texas Hold'Em™ poker game.

FIG. 4C shows a pay table for events that may be executed in the underlying gaming event or as a side bet wagering event useful in conjunction with the Free Money Texas Hold'Em™ poker game.

Figure 3A:
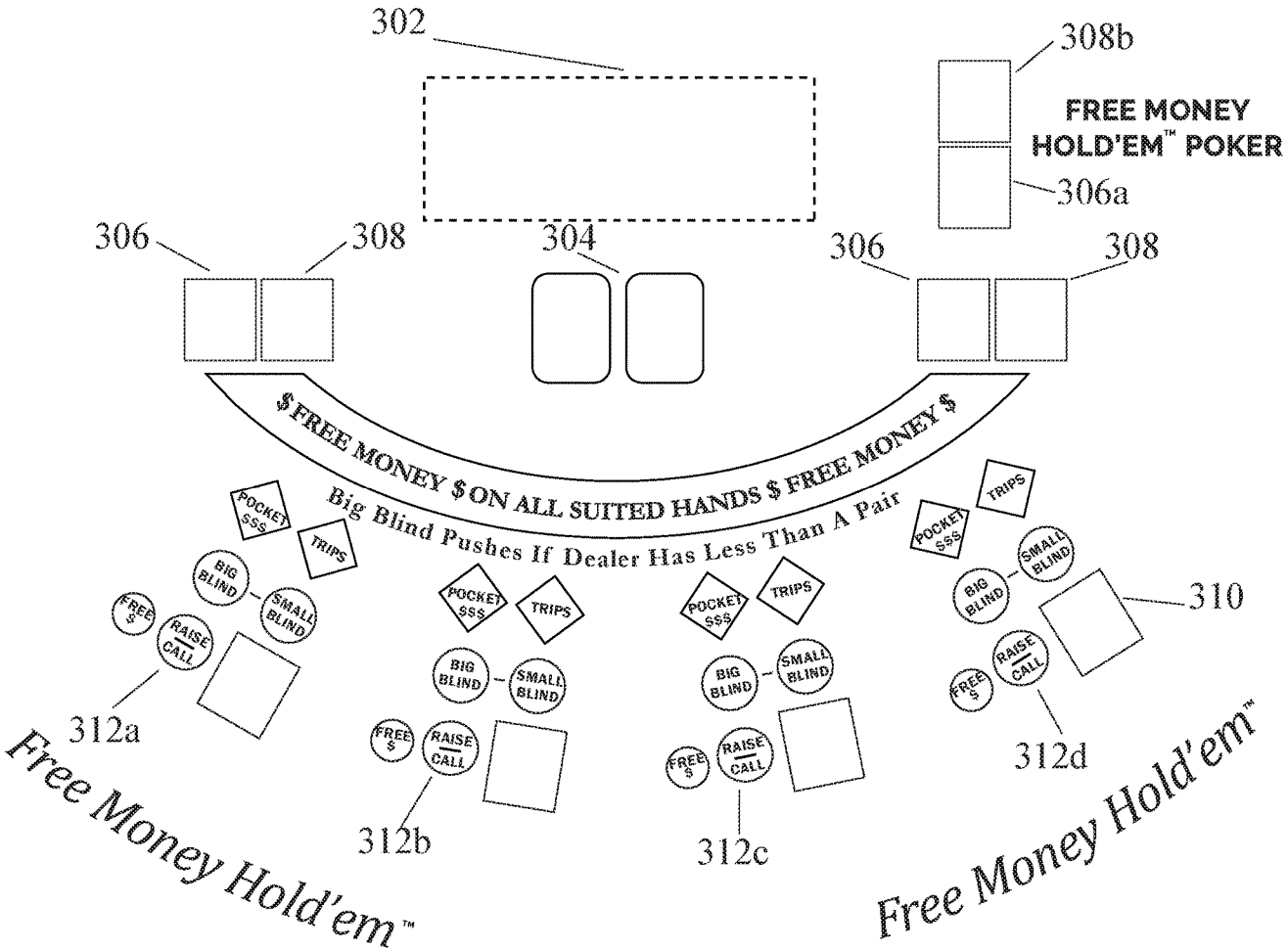
FIG. 3A shows a top view of a physical table layout for a version of a wagering event within the practice of the present technology known as Free Money Texas Hold'Em™ poker game, including a uniquely identified area for placement of a non-redeemable wager-enhancing marker adjacent at least one wager position on a player position at the gaming table.

There are many variables available for use in the execution of the present gaming technology. For example, but without limitation, the value-enhancing marker can be, as previously stated, an absolute amount or a multiplier, may be provided to the gaming table before or after the player position initial hand is provided (and retained only upon placement of a play wager, e.g., the "Call/Raise" wager of FIG. 3A). The play wager may be required to be of a specific amount to enable retention of the value-enhancing wager, such that a Call wager may or may not be sufficient to retain the marker, but a raise of at least 2× the Ante wager to retain the value enhancement marker.

Additionally, the marker may be passed from one round of the play to next, either as a one-time carry-over when any round of play is lost, or in a bad-beat situation. A bad=beat situation may occur when an intermediate quality hand is achieved at a player position (e.g., two pair, three-of-a-kind, straight) and yet the player hand loses to the dealer position.

The marker may be passed to a next hand when a player position wins with an at least quality or rank is achieved (such as at least three-of-a-kind). Multiple markers may or may not be accumulated from round-of-play to next round-of-play.

Other options may include allowing a pre-flop 3× play/raise wager, with no marker, then a 1× marker (or absolute amount marker such as 1.00, $2.00 or $5.00), with a 2× play/raise wager. The size of the marker may increase with the relative size/value of pre-flop wagers. A separate side bet wager against a paytable may be made prior to the player position initial hands being provided or after the player position initial hands have been delivered. A paytable for the latter would likely offer lower odds than for the former method of placing the side bet wager, such as a "Trips" or better wager.

The present gaming technology may also be executed over the internet using existing on-line technology such as that known in the following literature which is incorporated herein by reference in their entireties. The apparatus, structure and methods are disclosed in US Patent Publications 20160140802 (Joao); 20150154824 (Johnson);

20150119137 (Alexander); 20130324214 (Shaw); 20130184079 (Costello); and 20110159952 (Kerr).

In computer-based embodiments, the gaming device preferably includes at least one processor, such as a microprocessor, a microcontroller-based platform, a suitable integrated circuit or one or more application-specific integrated circuits (ASIC's) or Field Programmable Gated Arrays (FPGA's). The processor is in communication with or operable to access or to exchange signals with at least one data storage or memory device, and/or a player monitor or monitors. In one embodiment, the processor and the memory device reside within the cabinet of a gaming device. Multiple gaming devices are typically connected to a casino information network.

The memory device stores program code and instructions, executable by the processor, to control the gaming device. The memory device also stores other data such as image data, event data, player input data, random or pseudo-random number generators, pay-table data or information, House Ways distributions and applicable game rules that relate to the play of the gaming device. In one embodiment, the memory device includes random access memory (RAM): which can include non-volatile RAM (NVRAM): magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device.

In other embodiments, part or all of the program code and/or operating data described above can be downloaded to the memory device through a suitable network. In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. The gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "processor" or "computer" or "controller" or "game controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome. It is also possible for templates or weighted templates of sets of tiles or paylines as disclosed in U.S. Pat. Nos. 6,159,096 and 6,117,009 (Yoseloff, which are incorporated by reference in their entirety) which disclose a method of configuring a video output gaming device to randomly generate game outcomes. The method includes the steps of selecting a set of game symbols, assigning a probability of occurrence to each symbol, selecting a plurality of outcome templates, each template comprising X variables, selecting a probability of occurrence for each outcome template, assigning a subset of symbols from the set of game symbols to each template for filling the positions, defining payouts for selected outcomes, and configuring a video output gaming device, which randomly selects a template, randomly selects a symbol for each variable in the template from the subset of game symbols assigned to the selected template, randomly fills at least a portion of the positions in the template and displays the outcome on a video output display. A video output gaming device programmed to randomly select a template, randomly select symbols to define the variables and randomly display the selected symbols is also disclosed.

In one embodiment, described in more detail below as a "chipless gaming platform", the gaming device includes one or more display devices that are mounted into a gaming table surface and are controlled by the processor in addition to or separately from the individual player monitors. The display devices are preferably connected to or mounted into the table structure. This may include a central display device which displays a primary game, dealer images, jackpot information, or information that is not specifically related to the game, such as sports information or winning events at other tables. This display device may also display any suitable secondary game associated with the primary game as well as information relating to the primary or secondary game (e.g., side bets, bonuses, jackpots and the like).

An alternative embodiment may include a central horizontal game display device and a vertically oriented virtual dealer display device as in Shuffle Master, Inc.'s Table Master™ gaming system. The central display device may display the primary game, any suitable secondary game associated or not associated with the primary game and/or information relating to the primary or secondary game. These display devices may also serve as digital glass operable to advertise games or other aspects of the gaming establishment. The gaming device includes a credit display 20 which displays a player's current number of credits, cash, account balance, or the equivalent. In one embodiment, the gaming device includes a bet display displays a player's amount wagered. In one embodiment, as described in more detail below, the gaming device includes a player tracking display which displays information regarding a player's play tracking status.

In yet another embodiment, at least one display device may be a mobile display device, such as a PDA or tablet PC that enables play of at least a portion of the primary or secondary game at a location remote from the gaming device. The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism.

In one embodiment, as described in more detail below, the display device includes a touch-screen with an associated touch-screen controller. The display devices may be of any suitable size and configuration, such as a square, a rectangle or an elongated rectangle. The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, images of dealers and the like.

Other forms of the invention are in the form of game software that is implemented in a variety of formats, such as internet gaming, PC practice play, hand-held game devices, wireless gaming devices and the like.

Chipless Gaming Table Implementation

One enabling system useful in the practice of the present invention is the use of playing cards with Chinese domino symbols which can be distributed for use with a system marketed under the name i-TABLE™ by Shuffle Master, Inc. of Las Vegas, Nev. That system includes: a) a physical gaming table; b) player monitors at each player position; c) a playing card reading and delivery system (e.g., commercially available shufflers and playing card delivery shoes with reading capability as sold under the Trade names of One2Six™ shuffler, Ace™ shuffler, I-DEAL™ shuffler, I-SHOE™ delivery shoe, etc.); d) a processor receiving information (numbers of cards, rank of cards, suits of cards, etc.) from the card reading and delivery systems; e) communication connectivity (hardwired or wireless) between necessary combinations of the card reading/delivery systems and the processor, the processor and the individual player monitors, and/or the card reading/delivery systems and the video monitors; and f) software in the processor that defines predetermined advantage for distributions of playing cards into multiple hands, game rules, hand history, and the like. In order to prevent a bet pattern exceeding the number of possible hands in a "live" shoe, a card count will be tracked and the remaining cards will be continually divided by six (the maximum number of cards for a hand).

With regard to software f), it is understood in the practice of the present technology that this is not complex software that reads individual player hand cards and determines advantageous card distributions for a first time by extensive calculations. Rather, the entire range of possibilities of hands (e.g., all possible five card sets dealt to players in poker-style games) is known in poker style games.

A preferable card handling device for administering a video reel-type-style game is a hand-forming shuffler with integrated card recognition technology, from which playing cards are supplied, with a least a rank/count (and preferable also suit) of individual packs of cards are known before the cards are removed and delivered to player positions and/or the banker position. The card delivery system 102 is in communication with the controller 128 by wired or wireless communication methods. Communication between the various system components is not limited to electronic or electrical signals, but may include optical signals, audio signals, magnetic transmission or the like.

The individual player position processors (not shown) are preferable graphics processors and not full content CPUs as a cost saving, space saving, and efficiency benefit. With the reduced capacity in the processor as compared to a CPU, there is actually reduced likelihood of tampering and fraudulent input.

Turning next to FIG. 1, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown, or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video blackjack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a fluorescent display 16 for displaying plays tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of volatile memory. The coding instructions on the EPROM are static (non-changeable) and must be approved by a gaining regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine. 1

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include ETA 485, ETA 422, Fiber Optic Serial, optically coupled serial interfaces, current loop style serial interfaces, etc. In addition, to conserve serial interfaces internally in the slot machine, serial devices may be connected in a shared, daisy-chain fashion, where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaining computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the fluorescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022.

Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention also relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

Although this disclosure gives specific numbers and dimensions and components, these are only specific examples within the generic scope of the invention represented by the claims. Some variations within the scope of this generic invention include at least the following methods and systems. These include a method of executing a poker wagering event on a physical gaming table with physical playing cards between a player and a dealer banked by a wagering establishment and using a unique set of value-increasing marking elements, the method including:

providing a randomized set of physical playing cards comprising at least one standard deck of 52 playing cards;

at least one player placing an ante wager at an at least one player position for the at least one player;

providing exactly two random playing cards from the randomized set of physical playing cards to the at least one player position where the ante wager has been placed to form an initial player position two-card hand;

providing exactly two random playing cards from the randomized set of physical playing cards to the dealer position to form an initial dealer position two-card hand;

comparing a two-card poker hand rank of the exactly two playing cards at the at least one player position against a paytable, wherein at least some two card poker hand ranks require the dealer to place one value-increasing marker at the player position indicating that at least the ante wager has been multiplied in effective wagering value in execution of the poker wagering event, wherein the value-increasing marker is selected from the group consisting of a physical marker placed by a dealer and an electronic indication visually displaying an amount of value-enhancement randomly or specifically provided to the player position (An electronic indicator may be a visual display with information provided at the direction of the dealer by inputting at the dealer position by keyboard, button or touchscreen, or once the player position hand has been identified as meeting a predetermined condition qualifying the player position hand for a value-enhancement marker, a random number generator may provide a random value from within a range of values. Such a system may utilize technology disclosed in U.S. patent applications Ser. No. 15/376,841, filed 13 Dec. 2016 titled NOVEL GAMING TABLE, NOVEL EVENT GENERATOR AND METHOD OF ALTERING UNDERLYING GAMES ON THE GAME TABLE and Ser. No. 14/829,800, titled SIDE BETS FOR BLACKJACK OR BACCARAT WITH PROGRESSIVE EVENT in the name of Mark A. Litman; and five community playing cards are provided from the randomized set of physical playing cards for use in combination with each of the initial player position two-card hand and the initial dealer position two-card hand to form best five-of-seven five card poker hand ranks for respective the at least one player position and the dealer position;

comparing the best five-of-seven five card poker hand ranks for respective the at least one player position and the dealer position to determine a player position win, player position loss, or tie between the at least one player position and the dealer position;

wherein if the player position win results from the comparison, the ante wager is paid out according to a wagered amount of either the ante and the value-increasing marker and/or at least one play wager at the player position after provision of the exactly two random playing cards at the least one player position. In a physical system, the dealer may be a live dealer or an electronic virtual dealer operated by a processor and displayed on a screen or just results from the virtual dealer displayed on a screen.

A system for enabling execution of a wagering event may include:

a gaming table with a layout on a playing surface of the gaming table;

at least one standard poker deck comprising fifty-two playing cards;

multiple player positions at the gaming table, with wagering positions for each player position indicated on the surface of the gaming table;

at least one wagering position at a player position having markings indicating areas on the gaming table for placing at least a) an ante wager; b) at least one play wager; and c) a physical indicator for increasing at least one of the ante wager and the play wager;

wherein the physical indicator is a physical element movable and placeable by a dealer on the marking at the player position for placement of the physical indicator; and the physical indicator has no cashable value, but indicates an amount or multiplier added by the dealer to increase a player's wagered amount without requiring a player to risk any additional value other than the ante wager, the at least one play wager, and any side bets placed at the player position;

wherein the wagering event comprises a poker rank competition between distinct poker hands and each poker hand in the competition is formed from 1-2 hole cards in combination with multiple community cards.

The marking at the player position is most closely associated in location with respect to one of the markings on the gaming table surface for placing the ante wager or the at least one play wager. The system may have the physical indicator identify a specific non-redeemable cash amount or a multiplier applied to one of the ante wager and the at least one play wager. The system may use a multiplier including a multiplier value of between 1.5 and 4.0.

A method of executing a poker wagering event on an electronic gaming machine with virtual playing cards between a player and a virtual dealer may include:

providing an electronic gaming machine comprising a housing, a visual display at a player position, a processor with memory, and a player input control at the player position comprising a value-in-value-out system selected from the group consisting of a currency valuator, a ticket-in-ticket-out reader and printer, and a near-field transmitter/receiver for electronic fund transfer, the memory providing random outcome distribution of virtual playing cards from a randomized set of virtual playing cards comprising at least one standard deck of 52 playing cards;

a player placing an ante wager through player wager controls at the player input position;

the processor providing images of exactly two random virtual playing cards from the randomized set of virtual playing cards to the visual display to form an initial player position virtual two-card hand;

the processor providing images on the visual display of exactly two random virtual playing cards from the randomized set of virtual playing cards to a virtual dealer position to form an initial dealer position virtual two-card hand;

comparing a two-card poker hand rank of the exactly two virtual playing cards at the at least one player position against a paytable, wherein at least some two card poker hand ranks require the processor to place one virtual value-increasing virtual marker at the player position indicating that at least one of the ante wager and a subsequent play wager has been increased in effective wagering value in execution of the poker wagering event; and five community virtual playing cards are provided from the randomized set of virtual playing cards for use in combination with each of the initial player position two-card virtual hand and the initial virtual dealer position two-card virtual hand to form best five-of-seven five virtual card poker hand ranks for respective the at least one player position and the virtual dealer position;

comparing the best five-of-seven five virtual card poker hand ranks for respective the at least one player position and the virtual dealer position to determine a player position win, player position loss, or tie between the at least one player position and the virtual dealer position;

wherein if the player position win results from the comparison, the ante wager is paid out according to a wagered amount of the ante and the value-increasing virtual marker.

What is claimed:

1. A method of executing a poker wagering event on a physical gaming table with physical playing cards between a player and a dealer banked by a wagering establishment and using a unique set of value-increasing marking elements, the method comprising:

providing a randomized set of physical playing cards comprising at least one standard deck of 52 playing cards;

at least one player placing an ante wager at an at least one player position for the at least one player;

providing exactly two random playing cards from the randomized set of physical playing cards to the at least one player position where the ante wager has been placed to form an initial player position two-card hand;

providing exactly two random playing cards from the randomized set of physical playing cards to the dealer position to form an initial dealer position two-card hand;

comparing a two-card poker hand rank of the exactly two playing cards at the at least one player position against a paytable, wherein at least some two card poker hand ranks require the dealer to place one value-increasing marker at the player position indicating that at least the ante wager has been multiplied in effective wagering value in execution of the poker wagering event; and five community playing cards are provided from the randomized set of physical playing cards for use in combination with each of the initial player position two-card hand and the initial dealer position two-card hand to form best five-of-seven five card poker hand ranks for respective the at least one player position and the dealer position;

comparing the best five-of-seven five card poker hand ranks for respective the at least one player position and the dealer position to determine a player position win, player position loss, or tie between the at least one player position and the dealer position;

wherein if the player position win results from the comparison, the ante wager is paid out according to a wagered amount of the ante and the value-increasing marker.

2. The method of claim 1 wherein the value-increasing markers have an indication of a numerical multiplier effect of the value-increasing marker on the ante.

3. The method of claim 2 wherein a play wager is placed at the player position after the value-increasing marker has been placed at the player position.

4. The method of claim 3 wherein the play wager must have been placed at the at least one player position or the value-increasing marker is removed by the dealer.

5. The method of claim 3 wherein if the play wager has not been placed at the at least one player position, the value-increasing marker is remains at the at least one player position.

6. The method of claim 1 wherein the community playing cards are deposited at a community playing card position on the gaming table are deposited in subsets of fewer than five cards at a time, with wagering allowed at the at least one player position as a subset is deposited.

7. The method of claim 2 wherein the community playing cards are deposited at a community playing card position on the gaming table are deposited in subsets of fewer than five cards at a time, with wagering allowed at the at least one player position as a subset is deposited.

8. The method of claim 2 wherein the community playing cards are deposited at a community playing card position on the gaming table are deposited in subsets of fewer than five cards at a time, with wagering allowed at the at least one player position as a subset is deposited.

9. The method of claim 3 wherein the community playing cards are deposited at a community playing card position on the gaming table are deposited in subsets of fewer than five cards at a time, with wagering allowed at the at least one player position as a subset is deposited.

10. The method of claim 4 wherein the community playing cards are deposited at a community playing card position on the gaming table are deposited in subsets of fewer than five cards at a time, with wagering allowed at the at least one player position as a subset is deposited.

11. The method of claim 1 wherein the value-increasing marker is a physical token or plaque or tile having a numeric indication of a degree of multiplication provided in a player position winning outcome in the poker wagering event.

12. The method of claim 2 wherein the value-increasing marker is a physical token or plaque or tile having a numeric indication of a degree of multiplication provided in a player position winning outcome in the poker wagering event.

13. The method of claim 3 wherein the value-increasing marker is a physical token or plaque or tile having a numeric indication of a degree of multiplication provided in a player position winning outcome in the poker wagering event.

14. The method of claim 4 wherein the value-increasing marker is a physical token or plaque or tile having a numeric indication of a degree of multiplication provided in a player position winning outcome in the poker wagering event.

15. The method of claim 8 wherein the value-increasing marker is a physical token or plaque or tile having a numeric indication of a degree of multiplication provided in a player position winning outcome in the poker wagering event.

16. A method of executing a poker wagering event on a physical gaming table with physical playing cards between a player and a dealer banked by a wagering establishment and using a unique set of value-increasing marking elements, the method comprising:

providing a randomized set of physical playing cards comprising at least one standard deck of 52 playing cards;

at least one player placing an ante wager at an at least one player position for the at least one player;

providing exactly two random playing cards from the randomized set of physical playing cards to the at least one player position where the ante wager has been placed to form an initial player position two-card hand;

providing exactly two random playing cards from the randomized set of physical playing cards to the dealer position to form an initial dealer position two-card hand;

comparing a two-card poker hand rank of the exactly two playing cards at the at least one player position against a paytable, wherein at least some two card poker hand ranks require the dealer to place one value-increasing marker at the player position indicating that at least the ante wager has been multiplied in effective wagering value in execution of the poker wagering event, wherein the value-increasing marker is selected from the group consisting of a physical marker placed by a dealer and an electronic indication visually displaying an amount of value-enhancement randomly or specifically provided to the player position; and five community playing cards are provided from the randomized set of physical playing cards for use in combination with each of the initial player position two-card hand and the initial dealer position two-card hand to form best five-of-seven five card poker hand ranks for respective the at least one player position and the dealer position;

comparing the best five-of-seven five card poker hand ranks for respective the at least one player position and the dealer position to determine a player position win, player position loss, or tie between the at least one player position and the dealer position;

wherein if the player position win results from the comparison, the ante wager is paid out according to a wagered amount of either the ante and the value-increasing marker and/or at least one play wager at the player position after provision of the exactly two random playing cards at the least one player position.

17. A system for enabling execution of a wagering event comprising:

a gaming table with a layout on a playing surface of the gaming table;

at least one standard poker deck comprising fifty-two playing cards;

multiple player positions at the gaming table, with wagering positions for each player position indicated on the surface of the gaming table;

at least one wagering position at a player position having markings indicating areas on the gaming table for placing at least a) an ante wager; b) at least one play wager; and c) a physical indicator for increasing at least one of the ante wager and the play wager;

wherein the physical indicator is a physical element movable and placeable by a dealer on the marking at the player position for placement of the physical indicator; and the physical indicator has no cashable value, but indicates an amount or multiplier added by the dealer to increase a player's wagered amount without requiring a player to risk any additional value other than the ante wager, the at least one play wager, and any side bets placed at the player position;

wherein the wagering event comprises a poker rank competition between distinct poker hands and each poker hand in the competition is formed from 1-2 hole cards in combination with multiple community cards.

18. The system of claim 17 wherein the marking at the player position is most closely associated in location with respect to one of the markings on the gaming table surface for placing the ante wager or the at least one play wager.

19. The system of claim 18 wherein the physical indicator identifies a specific non-redeemable cash amount or a multiplier applied to one of the ante wager and the at least one play wager.

20. The system of claim 19 wherein the multiplier includes a multiplier value of between 1.5 and 4.0.

21. A method of executing a poker wagering event on an electronic gaming machine with virtual playing cards between a player and a virtual dealer comprising:

providing an electronic gaming machine comprising a housing, a visual display at a player position, a processor with memory, and a player input control at the player position comprising a value-in-value-out system selected from the group consisting of a currency valuator, a ticket-in-ticket-out reader and printer, and a near-field transmitter/receiver for electronic fund transfer, the memory providing random outcome distribution of virtual playing cards from a randomized set of virtual playing cards comprising at least one standard deck of 52 playing cards;

a player placing an ante wager through player wager controls at the player input position;

the processor providing images of exactly two random virtual playing cards from the randomized set of virtual playing cards to the visual display to form an initial player position virtual two-card hand;

the processor providing images on the visual display of exactly two random virtual playing cards from the randomized set of virtual playing cards to a virtual dealer position to form an initial dealer position virtual two-card hand;

comparing a two-card poker hand rank of the exactly two virtual playing cards at the at least one player position against a paytable, wherein at least some two card poker hand ranks require the processor to place one virtual value-increasing virtual marker at the player position indicating that at least one of the ante wager and a subsequent play wager has been increased in effective wagering value in execution of the poker wagering event; and five community virtual playing cards are provided from the randomized set of virtual playing cards for use in combination with each of the initial player position two-card virtual hand and the initial virtual dealer position two-card virtual hand to form best five-of-seven five virtual card poker hand ranks for respective the at least one player position and the virtual dealer position;

comparing the best five-of-seven five virtual card poker hand ranks for respective the at least one player position and the virtual dealer position to determine a player position win, player position loss, or tie between the at least one player position and the virtual dealer position;

wherein if the player position win results from the comparison, the ante wager is paid out according to a wagered amount of the ante and the value-increasing virtual marker.

* * * * *